US011739491B2

(12) United States Patent
Sim et al.

(10) Patent No.: US 11,739,491 B2
(45) Date of Patent: Aug. 29, 2023

(54) HYBRID PERMANENT ANCHOR

(71) Applicants: Dong—A Special Construction Co., Ltd., Seoul (KR); Suck Rae Sim, Seoul (KR); Nan Hee Lee, Seoul (KR)

(72) Inventors: Suck Rae Sim, Seoul (KR); Nan Hee Lee, Seoul (KR)

(73) Assignees: DONG—A SPECIAL CONSTRUCTION CO., LTD., Seoul (KR); Suck Rae Sim, Seoul (KR); Nan Hee Lee, Seoul (KR)

( * ) Notice: Subject to any disclaimer, the term of this patent is extended or adjusted under 35 U.S.C. 154(b) by 85 days.

(21) Appl. No.: 17/313,375

(22) Filed: May 6, 2021

(65) Prior Publication Data

US 2021/0348352 A1 Nov. 11, 2021

(30) Foreign Application Priority Data

May 7, 2020 (KR) ..... 10-2020-0054701

(51) Int. Cl.
*E02D 5/80* (2006.01)

(52) U.S. Cl.
CPC ..... *E02D 5/808* (2013.01); *E02D 2300/0034* (2013.01); *E02D 2300/0051* (2013.01); *E02D 2600/30* (2013.01)

(58) Field of Classification Search
CPC combination set(s) only.
See application file for complete search history.

(56) References Cited

U.S. PATENT DOCUMENTS

| | | | | |
|---|---|---|---|---|
| 10,190,281 | B2 * | 1/2019 | Xu | E21D 21/00 |
| 2018/0202122 | A1 * | 7/2018 | Xu | E02D 5/808 |

FOREIGN PATENT DOCUMENTS

| | | | | |
|---|---|---|---|---|
| KR | 10-2000-0002706 | A | | 1/2000 |
| KR | 200400676 | Y1 | * | 11/2005 |
| KR | 10-0901140 | B1 | | 6/2009 |
| KR | 20140022304 | A | * | 2/2014 |
| KR | 10-2016-0066766 | A | | 6/2016 |
| KR | 20180016007 | A | * | 2/2018 |
| KR | 10-1929420 | B1 | | 12/2018 |
| KR | 10-2019-0000532 | A | | 1/2019 |

* cited by examiner

*Primary Examiner* — Kyle Armstrong
(74) *Attorney, Agent, or Firm* — NKL Law; Jae Youn Kim

(57) ABSTRACT

A hybrid permanent anchor is proposed. The hybrid permanent anchor includes: a fixed body disposed between a compression part and a tension part and coupling the compression part and the tension part to each other; the tension part coupled to a front end of the fixed body and transmitting tension to the permanent anchor when tensile stress is generated; the compression part coupled to a rear end of the fixed body and transmitting compressive force to the permanent anchor when compressive stress is generated; a PC steel strand coupled to a rear end of the compression part and having a protective pipe thereon; and an anchor head part fixing the permanent anchor to a structure.

5 Claims, 8 Drawing Sheets

| Max (kN) | 100kN | 200kN | 300kN | 400kN |
|---|---|---|---|---|
| | 37.4 | 89.4 | 140.8 | 193.3 |

| Max (kN) | 100kN | 200kN | 300kN | 400kN |
|---|---|---|---|---|
| | 84.8 | 184.0 | 283.5 | 383.3 |

| item | 100kN | 200kN | 300kN | 400kN |
|---|---|---|---|---|
| difference value (kN) (compression-compression tension) | 47.4 | 94.6 | 142.7 | 190.0 |
| reduction ratio | 55.9% | 51.4% | 50.3% | 49.6% |

HYBRID PERMANENT ANCHOR

CROSS REFERENCE TO RELATED APPLICATION

This application claims priority to and the benefit of Korean Patent Application No. 10-2020-0054701, filed on May 7, 2020, the disclosure of which is incorporated herein by reference in its entirety.

BACKGROUND OF THE INVENTION

Technical Field

An embodiment of the present disclosure relates to a hybrid permanent anchor and, more particularly, to distribute and reduce a concentrated-load generated in a permanent anchor to ¼ using only the advantages of a tension type and a compression type to be advantageous in terms of maintaining force for a long period of time, thereby considerably improving the quality and reliability of the permanent anchor to give a good image.

Description of the Related Art

It should be noted that the present disclosure has been improved from previously registered patents by the applicant(s).

As well known, an anchor is a device that transmits load from a structure to the ground by tensioning a tension member (e.g., a PC steel bar, a PC steel wire, a PC steel strand, etc.) installed in the ground.

Such anchors are, depending on the ground for fixation, classified into a solid anchor that is fixed in a soil ground and a rock anchor that is fixed in a rock, which are, in combination, referred to as ground anchors.

In particular, ground anchoring, which is an effective construction method of applying a restriction force or a pre-load by applying high tension to a high-strength structural steel to fix civil or constructional structures to the ground, is used for timbering of a temporary retaining wall, a permanent anchor retaining wall, a transmission tower foundation, reinforcement of a dam, a floating anchor for an underground structure, slope reinforcement, etc. Further, ground anchoring can achieve economic efficiency and large pullout resistance and has excellent ease of construction, so it is actively applied inside and outside the country.

A ground anchor is composed of an "anchor body (fixed body length)" having a function of transmitting tension of a tension part to the ground, a "tension part (free length)" transmitting tension from an anchor head to the anchor body, and an "anchor head" having a function of fixing the anchor to a structure. Anchors are classified into a permanent anchor and a temporary anchor in accordance with the use period and the shapes of the parts of anchor are slightly different, depending on the anchor construction methods and the components thereof.

Depending on the use period, an anchor that is used to temporarily reinforce a temporary retaining wall or the ground is called a temporary anchor and temporary anchors are designed to be able to keep the initial tension for at least six months or more. Since the use period is short, it is not required to continuously observe corrosion and behaviors of the anchors. An anchor that is related to the remaining period of a structure and is usually used for a long period of two years or more is called a permanent anchor. Permanent anchors should be able to support load for a long period and it is required to continuously observe corrosion and the behavior of the permanent anchors.

Meanwhile, anchors are further classified in accordance with the generation stress of grout. In this case, when tensile stress is generated, it may be called a tension anchor, and when compressive stress is generated, it may be called a compression anchor.

Such a tension anchor is widely used inside and outside the country as a most common anchor, and has an advantage that there are sufficient study results and actual construction results, but has a fault that progressive failure is generated by tensile cracks in grout and creep due to load concentration, so load reduction is large. Accordingly, as shown in FIG. 2, load transition is shown in the early stage in which load is applied, as indicated by a curve ①, but as time passes, the curve changes into the curve indicated by ③ due to the reasons described above, in which the load decreases.

Such a compression anchor was relatively recently developed to make up for tension cracks, corrosion, or the like that is the fault of the tension anchor and is used in various ways for permanent and temporary purposes. The compression anchor has a fault that load reduction due to creep is small in comparison to the tension anchor, but high-strength grout is required and it is difficult to secure a predetermined level of anchoring force in a relatively weak ground. In front-compression anchors, load transition changes from ① to ③ due to these reasons, so load decreases. Recently, a load distribution compression anchor has been developed and used to make up for the faults of the tension and compression anchors.

Accordingly, the following problems were found overall in these anchors of the related art described above.

That is, since tension anchors of the related art are tension types, creep (deformation) is generated by long-period tension, the outer diameter increases, and there is no effect at the boundary of a free length and a fixed part, that is, large problems were found.

Further, the compression anchors of the related art are broken when they are used for a long period of time due to a concentrated load at the lower fixed part when the free length is tensed and breakage is frequently generated between concrete and the anchors, that is, large problems were generated.

There is a structure obtained by mixing the tension type and the compression type to solve the problems in the related art, but a problem was found that concrete frequently breaks at the boundary between the tension type and the compression type.

The following prior art documents have been disclosed to solve the problems in the related art, but a problem that it is difficult to solve all of the problems in the related art was found.

Documents of Related Art (Patent Document 1) Korean Patent Application Publication No. 10-2000-0002706 (2000 Jan. 15)

(Patent Document 2) Korean Patent No. 10-1929420 (2018 Dec. 10)

SUMMARY OF THE INVENTION

The present disclosure has been made in an effort to solve the problems in the related art described above and an objective of the present disclosure is to provide a hybrid permanent anchor. A first objective of the present disclosure is to enable a permanent anchor have a tension part, a fixed body, a compression body, a PC steel strand, and an anchor head; a second objective is to distribute and reduce a concentrated-load generated in a permanent anchor to ¼ using only the advantages of a tension type and a compression type; a third objective is to reduce a divergence angle by dividing a concentrated load in both sides (up and down); a fourth objective is to reduce the divergence angle of force to be advantageous in terms of maintaining the force for a long period; a fifth objective is to prevent creep (deformation) by restriction pressure due to long-period tension at the boundary between a fixed body of a fixed length and a tension compression part; a sixth objective is to secure stability by reducing the outer diameter and length of a permanent anchor so that the effect of keeping the permanent anchor fixed can be increased; a seventh objective is to prevent breakage for a long period of time by distributing load at a lower fixed part when a free length is tensed; an eighth objective is to be able to manufacture a product that decreases load and increase anchoring force when an anchor is installed using FRP resin having low compression but large tension and being advantageous in terms of attachment for the tension part of a fixed body; an ninth objective is to prevent breakage between concrete and an anchor; a tenth objective is to prevent breakage of concrete at the boundary between a tension type and a compression type; and an eleventh objective is to remarkably improve the quality and reliability of a permanent anchor to be able to give a good image.

In order to achieve the objectives, the present disclosure provides a hybrid permanent anchor that includes: in order to distribute and reduce a concentrated load in the permanent anchor, a fixed body disposed between a compression part and a tension part and coupling the compression part and the tension part to each other; the tension part coupled to a front end of the fixed body and transmitting tension to the permanent anchor when tensile stress is generated; the compression part coupled to a rear end of the fixed body and transmitting compressive force to the permanent anchor when compressive stress is generated; a PC steel strand coupled to a rear end of the compression part and having a protective pipe thereon; and an anchor head part fixing the permanent anchor to a structure.

As described above, according to the present disclosure, a permanent anchor has a tension part, a fixed body, a compression part, a PC steel strand, and an anchor head part.

According to the present disclosure having this configuration, it is possible to distribute and reduce a concentrated-load generated in a permanent anchor to ¼ using only the advantages of a tension type and a compression type.

Further, it is possible to reduce a divergence angle by dividing a concentrated load in both sides (up and down).

Further, it is possible to reduce the divergence angle of force to be advantageous in terms of maintaining the force for a long period.

Further, it is possible to prevent creep (deformation) by restriction pressure due to long-period tension at the boundary between a fixed body of a fixed anchor length and a tension compression part.

Further, it is possible to secure stability by reducing the outer diameter and length of a permanent anchor so that the effect of keeping the permanent anchor fixed can be increased.

Further, it is possible to prevent damage for a long period of time by distributing load at a lower fixed part when a free anchor length is tensed.

Further, it is possible to manufacture a product that decreases load and increase anchoring force when an anchor is installed using FRP resin having low compression but large tension and being advantageous in terms of attachment for the tension part of a fixed body.

Further, it is possible to prevent breakage between concrete and an anchor.

Further, it is possible to prevent breakage of concrete at the boundary between a tension type and a compression type.

Since it is possible to remarkably improve the quality and reliability of a permanent anchor to be able to give a good image through the effects described above, the present disclosure is very useful.

Exemplary embodiments of the present disclosure for achieving the effects are described hereafter in detail with reference to the accompanying drawings.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
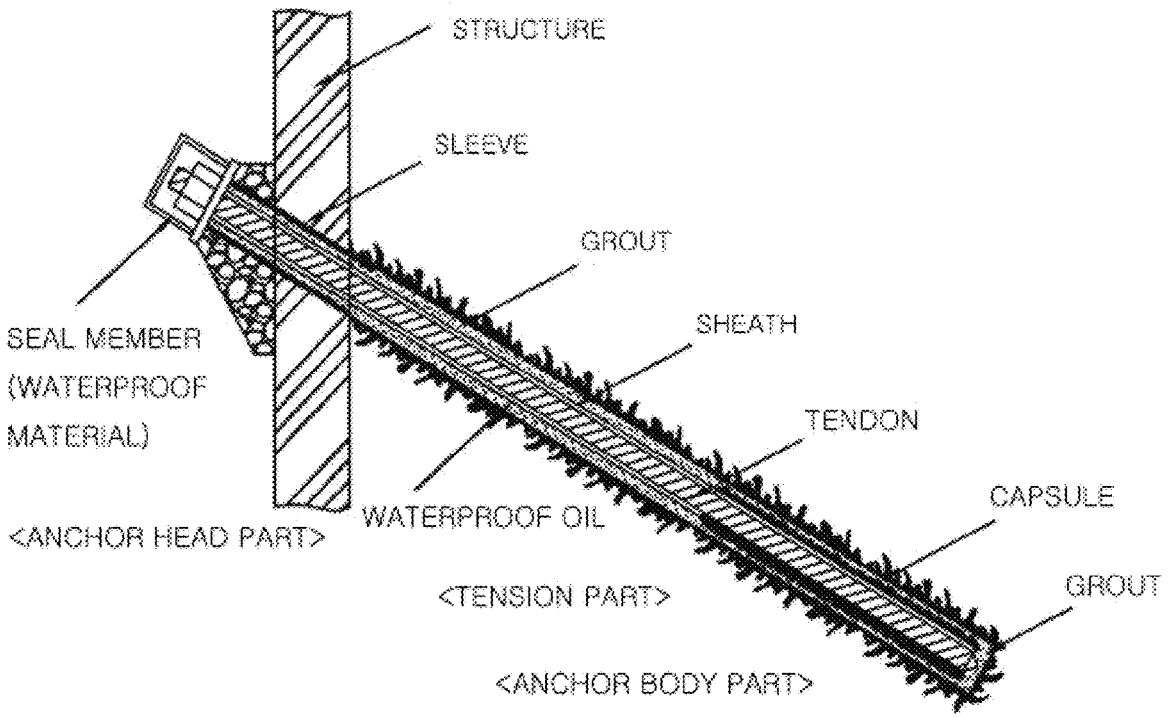
FIG. 1 PRIOR ART
FIG. 1 is a view showing the configuration of a permanent anchor of the related art.
Figure 2:
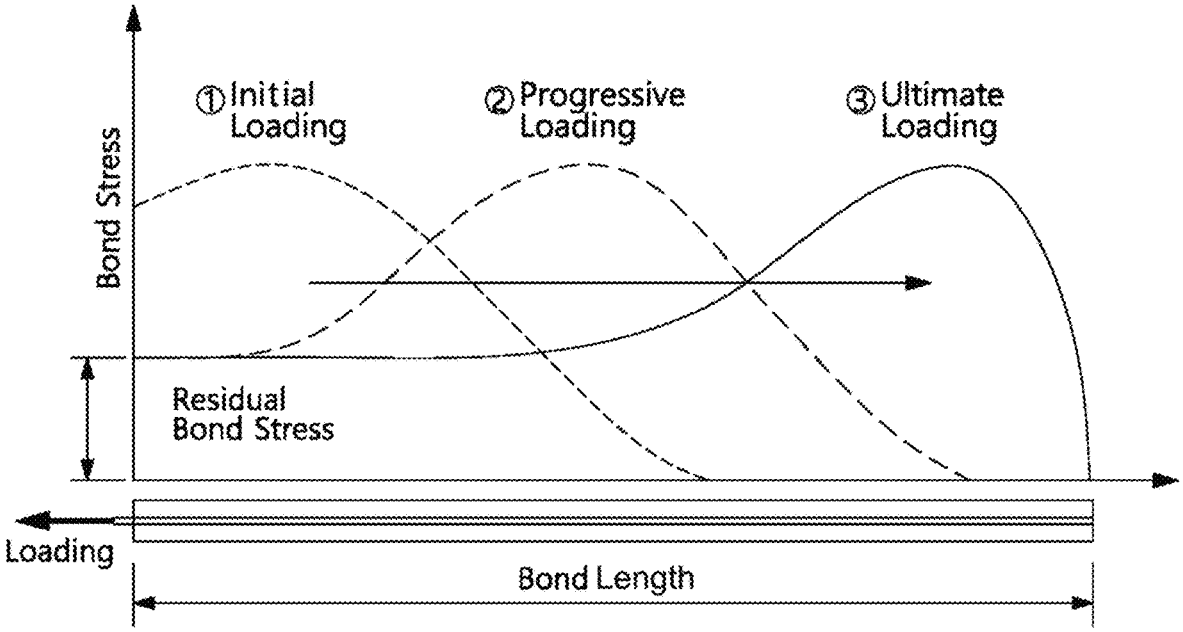
FIG. 2 PRIOR ART
FIG. 2 is a view showing schematically showing a tension anchor of the related art and a graph showing surrounding friction distribution.
Figure 3:
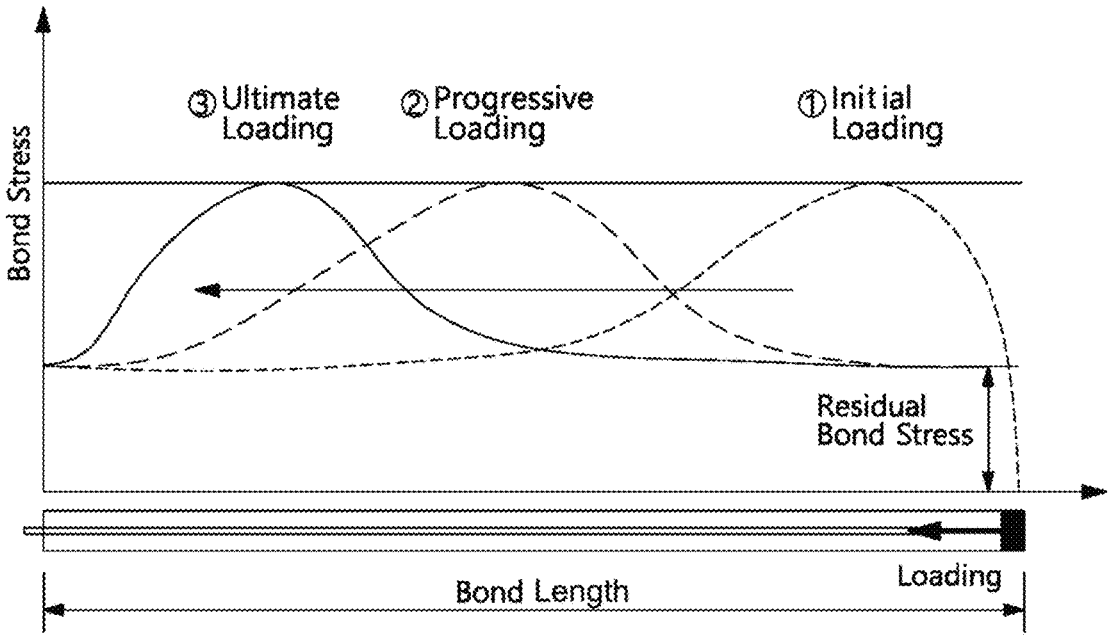
FIG. 3 PRIOR ART
FIG. 3 is a view showing schematically showing a compression anchor of the related art and a graph showing surrounding friction distribution.

A hybrid permanent anchor applied to the present disclosure has the configuration shown in FIGS. 4 to 9.

In the following description of the present disclosure, detailed descriptions of well-known functions or configurations relating to the disclosure will not be provided so as not to obscure the description of the disclosure with unnecessary details.

The terms to be described below are set in consideration of functions in the present disclosure and may be changed in accordance with the intention or usage of manufacturers, so the definition should be based on the entire specification.

Further, the sizes and thicknesses of the components shown the figures are selectively provided for the convenience of description and the present disclosure is not necessarily limited thereto.

First, the present disclosure has been designed to reduce a concentrated-load generated in a permanent anchor 100 to ¼ using only the advantages of a tension type and a compression type to be advantageous in terms of maintaining force for a long period of time.

To this end, the present disclosure has a fixed body (multi-compression part) 120 disposed between a compression part 130 and a tension part 110 (110*a*) and coupling the compression part and the tension part to be able to distribute and reduce a concentrated load applied to a permanent anchor 100.

Further, the present disclosure has the tension part 110 (FIG. 4) or the tension part 110*a* (FIG. 5) coupled to the front end of the fixed body 120 and transmitting tension to the permanent anchor when tensile stress is generated.

Further, the present disclosure has the compression part 130 coupled to the rear end of the fixed body 120 and transmitting compression force to the permanent anchor when compressive stress is generated.

Further, the present disclosure has PC steel strands 140 coupled to the rear end of the compression part 130 and having a protective pipe 145 outside.

The present disclosure provides a hybrid permanent anchor having an anchor head part 150 fixing the permanent anchor 100 to a structure.

In particular, the anchor head part 150 includes a pressing plate 156 being in contact with a lattice block, a head 150 holding the PC steel strands 140 through the pressing plate 156, a plurality of tension cones 155 fitted on the PC steel strands 140 pulled at a side of the head 153 to fix the PC steel strands 140, and an anchor cap 151 disposed at a side of the pressing plate 156 and protecting these components.

One or more fixing grooves 152 are formed inside the anchor cap 151 and fixing protrusions 154 protruding outward from the head 153 are inserted in the fixing grooves 152.

The fixed body 120 applied to the present disclosure has a bolt 123 for coupling to a fastening hole 112 of the tension part 110 at the front end and has a locking portion 121 for coupling a first set screw 122 to the compression part 130 at the rear end.

A spacer 125 functioning as a support for accurately maintaining the coating thickness of concrete may be disposed on the outer surface of the fixed body 120.

The tension part 110 applied to the present disclosure has the fastening hole 112 for fastening to the bolt 123 of the fixed body 120 and has one or more put-in holes 112 to put concrete therein.

Prominences and depressions are formed with regular intervals on the outer surface of the tension part 110. A through-hole 114 for putting concrete inside and an extending protrusion 113 being in surface contact with concrete are formed at protruding ribs of the prominences and depressions so that the contact area with concrete can be increased. In particular, the tension part 110 may be made of synthetic resin such as FRP that is light and can increase the roughness of the surface.

The compression part 130 and the pipe 145 are coupled to each other by a second set screw 131 and a tube 135 protecting the second set screw may be fitted on the outer surface of the second set screw 131.

Figure 5:
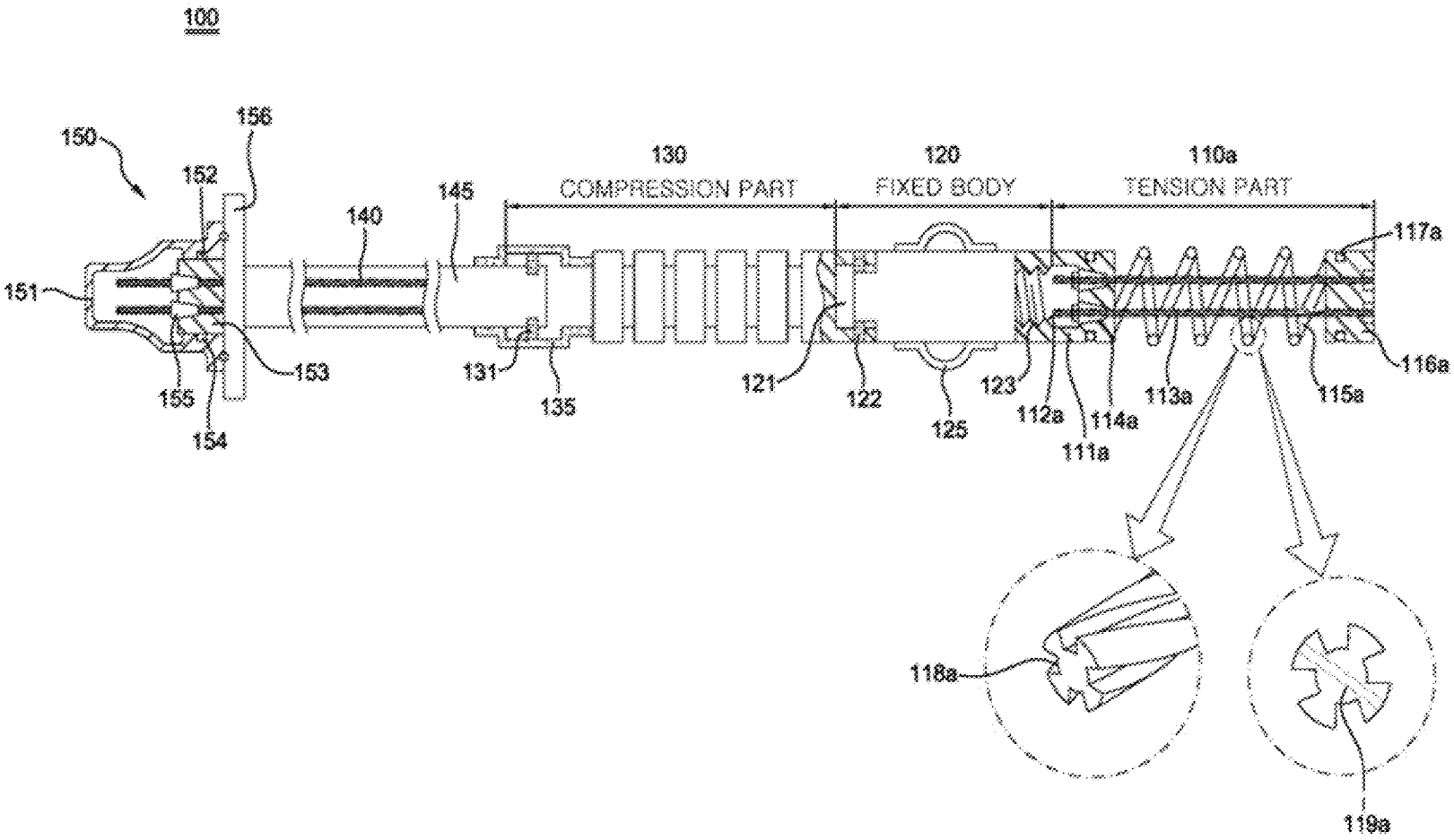
FIG. 5 is a view showing the configuration of a second embodiment of a hybrid permanent anchor applied to the present disclosure.

The tension part 110*a* according to another embodiment of the present disclosure has the following configuration (FIG. 5).

That is, the present disclosure has a first tension body 111*a* having a fastening hole 112*a* for fastening the bolt 123 of the fixed body 120.

The present disclosure has one or more tension wedges 114*a* fastened inside the first tension body 111*a* and holding wires 113*a*.

The present disclosure has the wire 113*a* each having one side coupled to the tension wedge 114*a* and another side coupled to a second tension body 116*a*.

In particular, the present disclosure has a coil 115*a* coupled between the first tension body 111*a* and the second tension body 116*a* and increasing attachment resistance to grout.

The coil 115*a* may be fitted in locking grooves 117*a* of the first tension body 111*a* and the second tension body 115*a* not to be easily separated.

The coil 115*a* may be twisted to maximize a contact area with grout.

A plurality of grooves 118*a* may be longitudinally formed on the coil 115*a* to increase attachment resistance to grout.

The coil 115*a* may further have a plurality of through-holes 119*a* in which grout permeates so that attachment resistance to the grout is increased.

The present disclosure may be changed in various ways and may have various shapes when the components described above are applied.

The present disclosure should not be construed as being limited to the specific embodiment described above, but should be construed as including all changes, equivalents, and substitutions within the spirit of the present disclosure defined in the claims.

The operational effects of the hybrid permanent anchor of the present disclosure having the configuration described above are as follows.

First, the present disclosure has been designed to reduce a concentrated-load generated in a permanent anchor to ¼ using only the advantages of a tension type and a compression type to be advantageous in terms of maintaining force for a long period of time.

Figure 4:
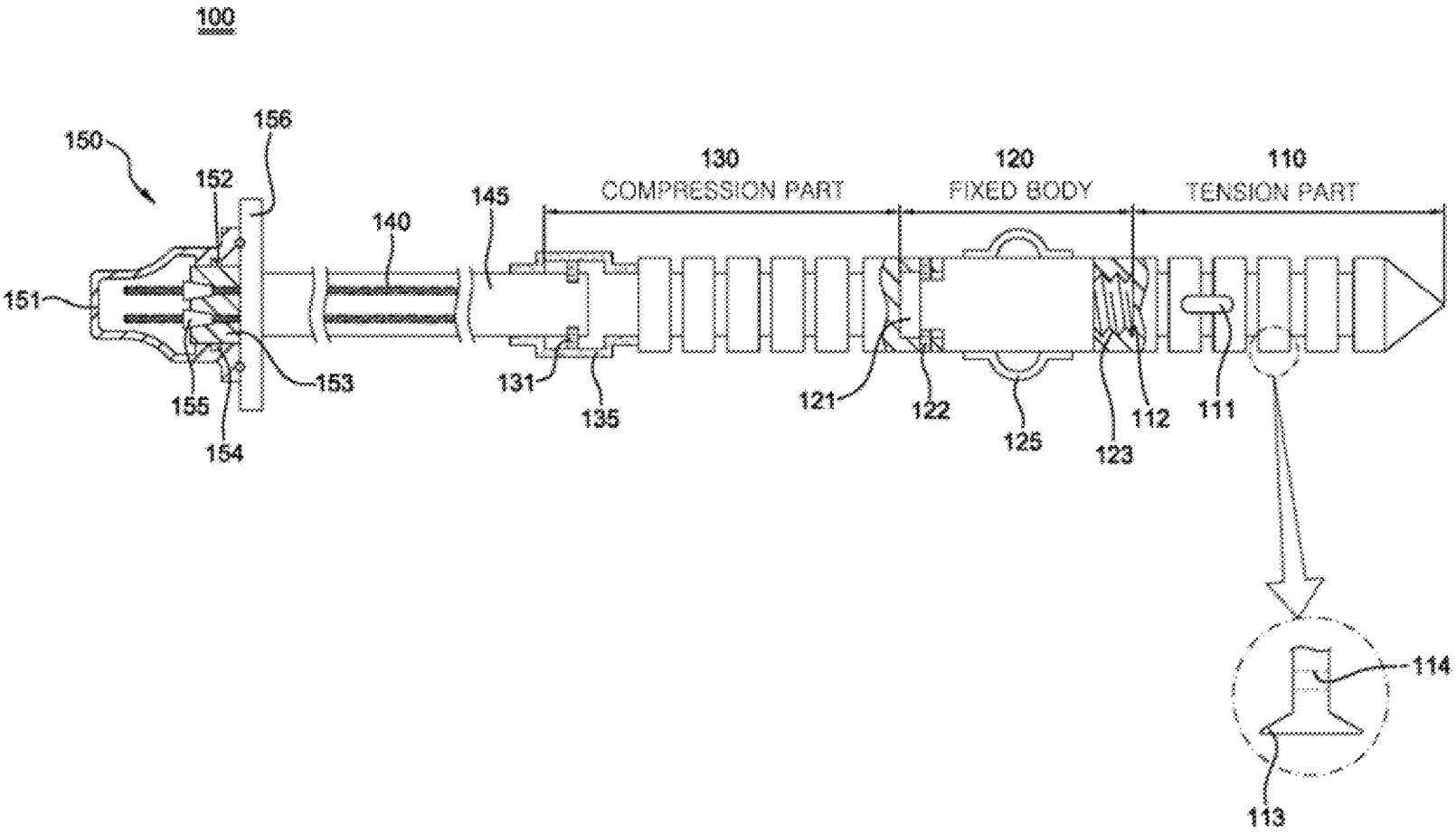
FIG. 4 is a view showing the configuration of a first embodiment of a hybrid permanent anchor applied to the present disclosure.

To this end, FIG. 4 shows the configuration of a first embodiment of the hybrid permanent anchor 100 of the present disclosure.

The present disclosure has the tension part 110 and the compression part 130 at both sides of the fixed part 120, and the pipe 145 having the PC steel strands 140 therein and the anchor head part 150 are sequentially connected to the compression part 130.

The assembly of the permanent anchor 100 of the present disclosure is installed by inserting the permanent anchor 10 into a hole formed in a slope, injecting grout into the hole, installing a lattice block, tensing the permanent anchor 100, and then coupling the anchor cap 151 of the anchor head part 150.

According to the present disclosure, the fastening hole 112 of the tension part 110 is fastened to the bolt 123 at the front end of the fixed body 120 and the first set screw 122 is fastened to the locking portion 121 at the rear end of the fixed body 120, whereby the tension part 110 and the compression part 130 are coupled with the fixed body 120 therebetween.

Concrete is put inside through the put-in hole 111 of the tension part 110, thereby being able to maximize friction with the ground and the tension part 110.

In particular, concrete is put into the through-holes 114 formed in the ribs of the prominences and depressions of the tension part 110 and concrete are in close contact with both ends of the extending protrusions 113, thereby the close contact force between the tension and the concrete can be further maximized.

According to the present disclosure, in the process described above, the compression part 130 distributes and reduces the load applied to the compression part 130 and the tension part 110 to ¼.

That is, according to the present disclosure, divergence angle of force is distributed and reduced in both directions to the compression part (◁) and the tension part (▷) from the fixed body 120 to be advantageous in terms of maintaining force for a long period of time.

Accordingly, since the present disclosure is divided into the tension part 110 and the compression part 130 with the fixed body 120 therebetween, the divergence angle of force can be distributed and reduced to both sides.

FIG. 5 shows the configuration of a second embodiment of the hybrid permanent anchor 100 of the present disclosure.

The second embodiment of the present disclosure is the same as the first embodiment except for the configuration and operation effects of the tension part 110*a*, so only these are described hereafter.

That is, according to the second embodiment of the present disclosure, the fastening hole 112 a of the tension part 110 a is fastened to the bolt 123 at the front end of the fixed body 120 and the first set screw 122 is fastened to the locking portion 121 at the rear end of the fixed body 120, whereby the tension part 110 a and the compression part 130 are coupled with the fixed body 120 therebetween.

In particular, according to the present disclosure, the wires 113*a* are connected to the tension wedge 114*a* between the first tension body 111*a* and the second tension body 116*a* and the coil 115*a* is fitted in the locking grooves 117*a* formed on the outer surfaces of the first tension body 111*a* and the second tension body 116*a*, whereby attachment resistance of the coils 115*a* and grout can be increased when grout is put inside later.

According to the present disclosure, the coil 115*a* is twisted and grout is in close contact with the groove 118*a* longitudinally elongated, whereby the close contact force between the coil 115*a* and the grout can be increased.

According to the present disclosure, through-holes 119*a* are formed with regular intervals in the coil 115*a*, so when grout is put into the through-holes 119*a*, close contact force and attachment resistance of the coil 115*a* and the grout can be increased.

Figure 6:
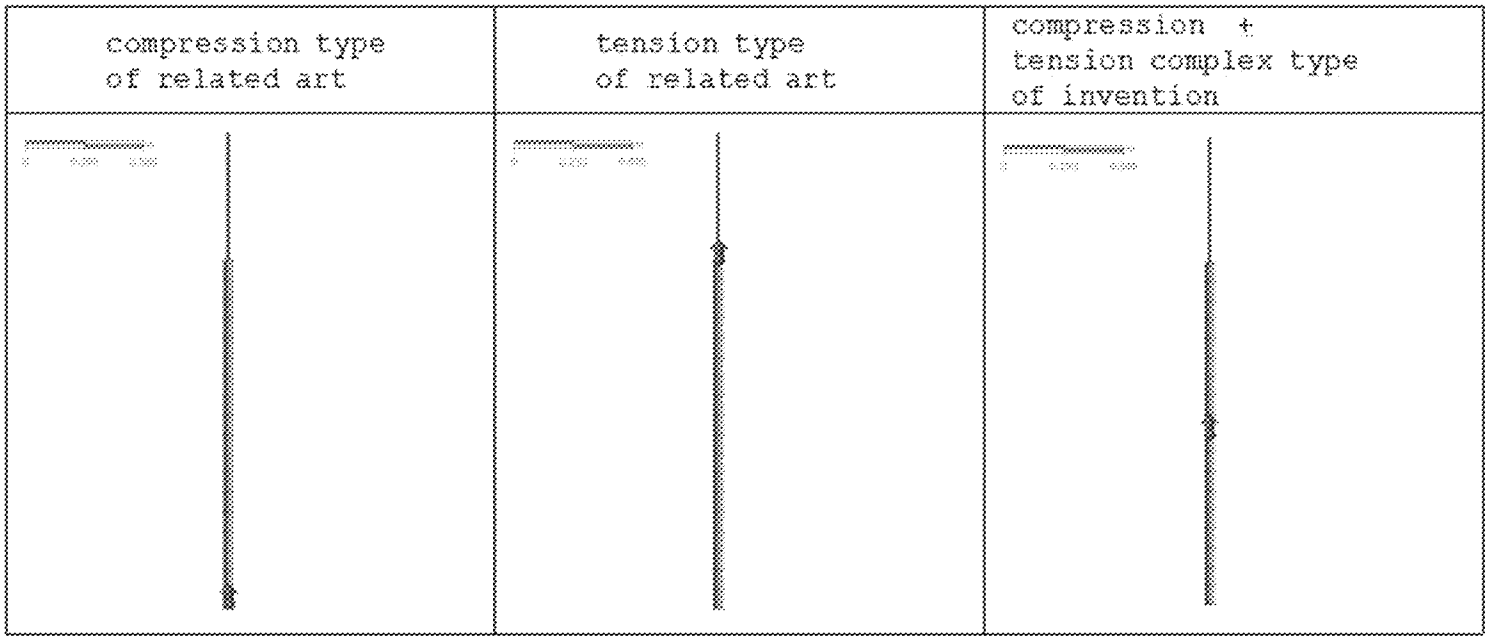
FIG. 6 is a view schematically comparing the behaviors of a hybrid permanent anchor applied to the present disclosure and compression and tension types of the related art.

FIG. 6 is a view schematically comparing the behaviors of the hybrid permanent anchor 100 applied to the present disclosure and compression and tension types of the related art.

That is, in FIG. 6, a load acting-point was positioned at the middle of the fixed body 120 to schematically show the hybrid permanent anchor 100 applied to the present disclosure, and load acting-points were positioned at the lowermost end and the uppermost end of fixed bodies to compare behaviors of high-strength compression anchor and tension anchor of the related art, in which the magnitude of load was changed within 100 kN~400 kN to show behaviors according to the magnitude of the load.

According to the result, load on the fixed body of the compression or tension anchor of the related art is transmitted in one direction, but load is transmitted in two directions in the compression+tension (complex) anchor, so pressure decreases to ¼. Accordingly, compression force applied to milk or cement between the anchor fixed body and the ground decreases, which is advantageous in terms of permanent installation.

Figure 7:
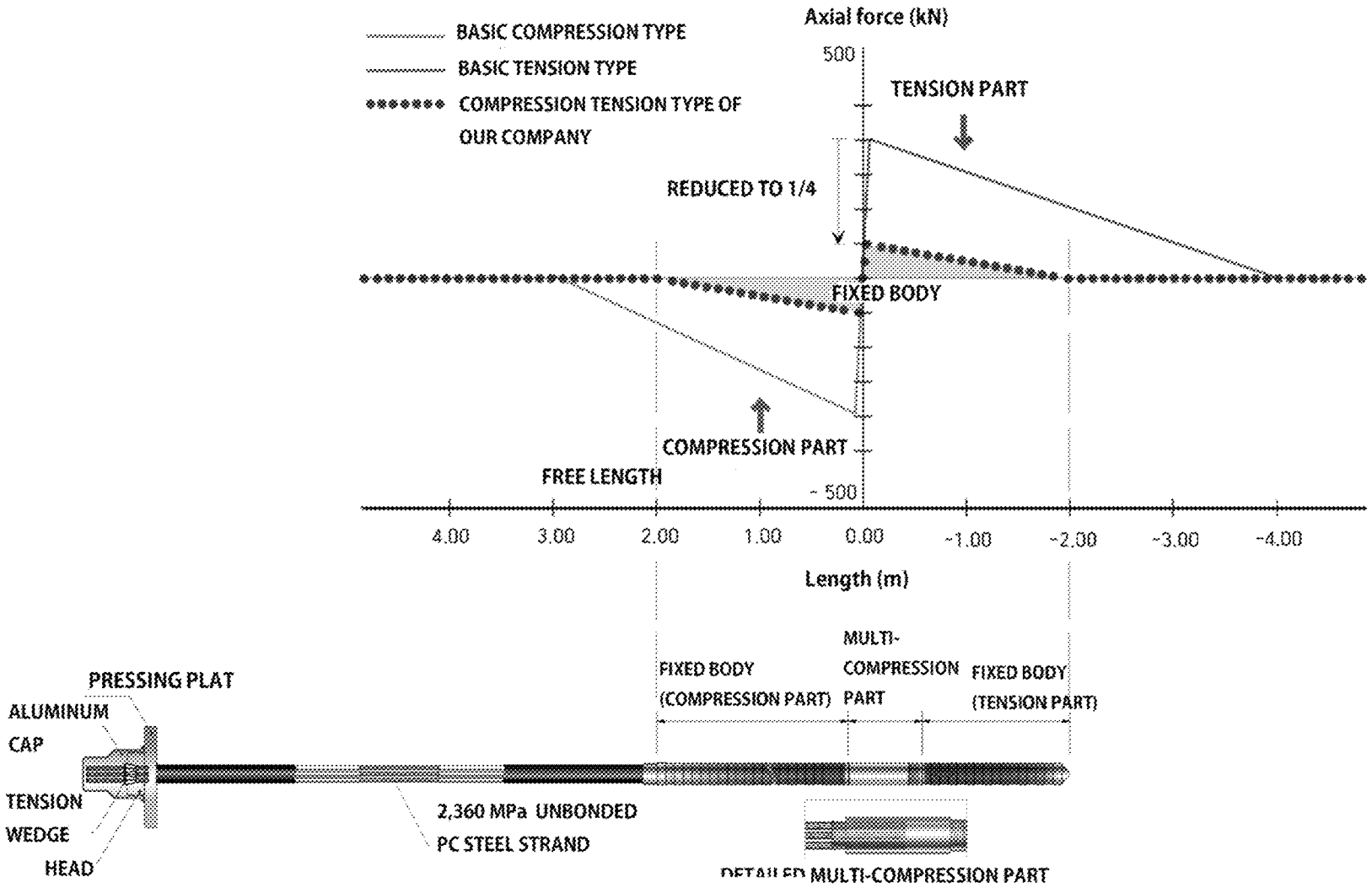
FIG. 7 is a graph the case in which a concentrated-load generation portion is reduced to ¼ in a hybrid permanent anchor applied to the present disclosure to be advantageous in terms of maintaining force for a long period.

FIG. 7 is a graph the case in which a concentrated-load generation portion is reduced to ¼ in the hybrid permanent anchor 100 applied to the present disclosure to be advantageous in terms of maintaining force for a long period.

That is, in the graph of FIG. 7, the orange color is an existing (basic) compression type, the green color is an existing (basic) tension type, and the blue dotted line is the hybrid permanent anchor applied to the present disclosure. Referring to FIG. 7, it can be seen that pressure decreases to ¼ around the fixed body 120 in comparison to the compression and tension types of the related art.

Figure 8:
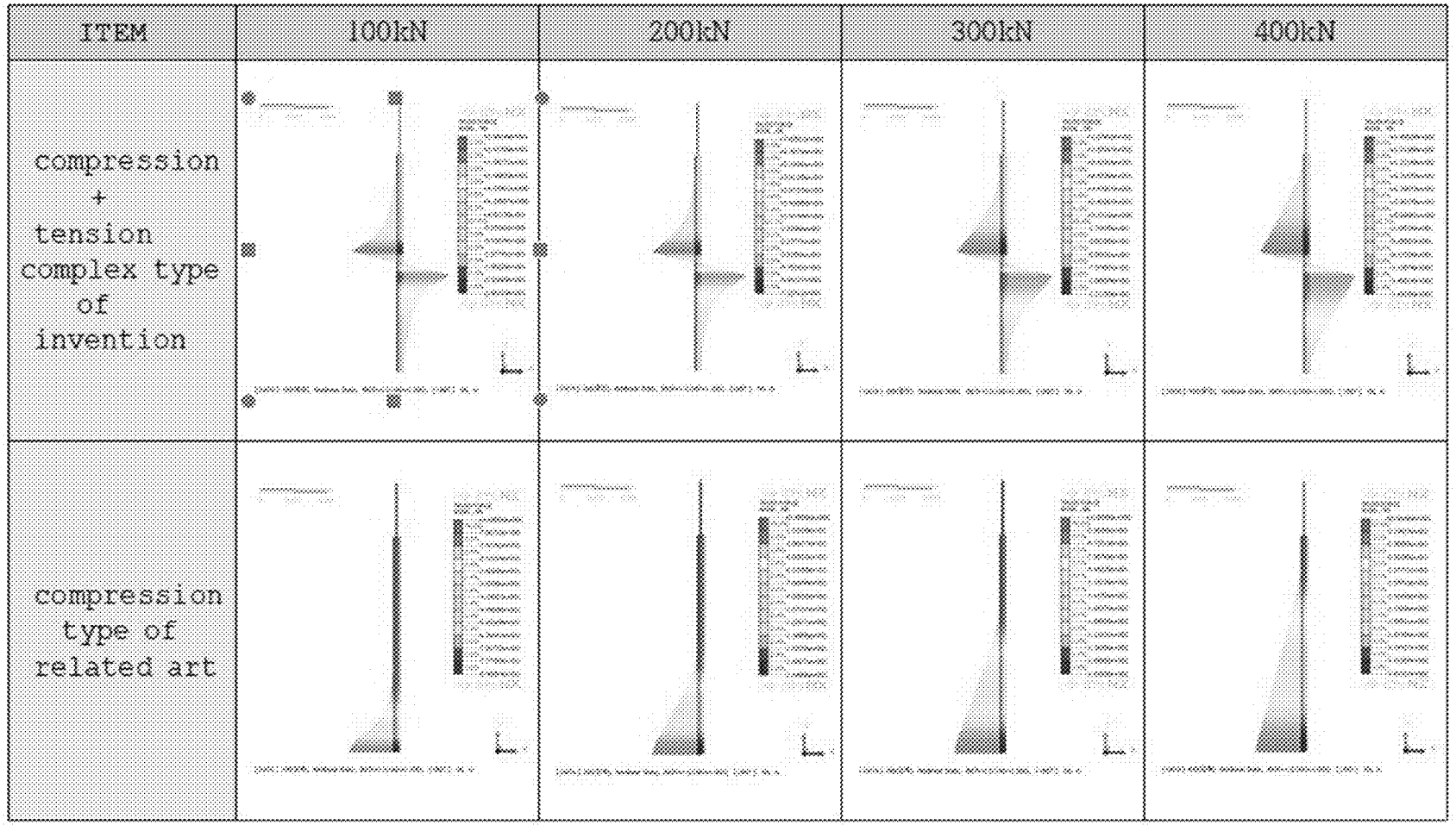
FIG. 8 is a view comparing axial forces (fixed lengths) of a hybrid permanent anchor applied to the present disclosure and a compression type of the related art.

FIG. 8 is a view comparing axial forces (fixed lengths) of the hybrid permanent anchor 100 applied to the present disclosure and a compression type of the related art.

Figure 9:
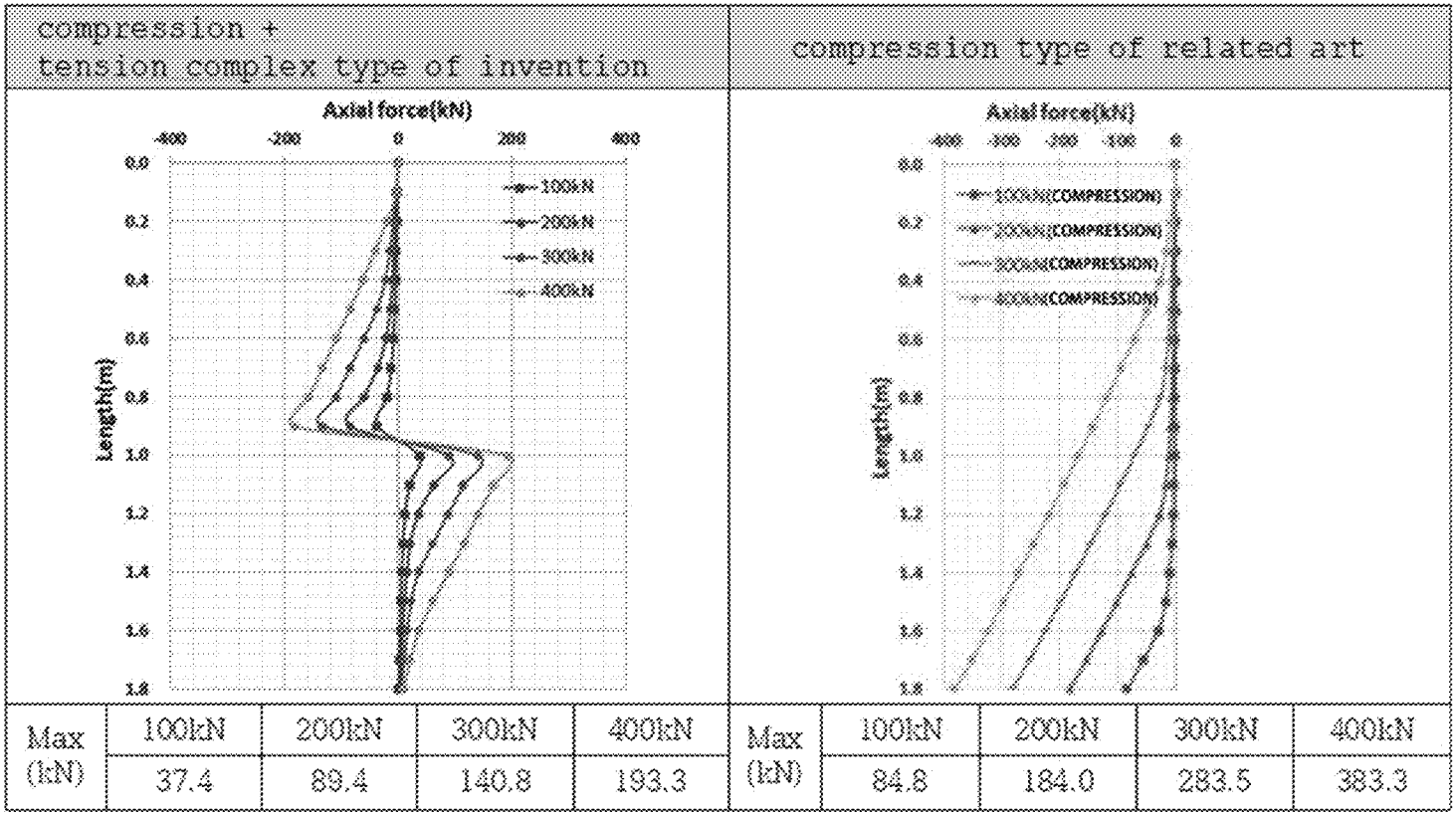
FIG. 9 is a graph showing result values comparing axial forces (fixed lengths) of a hybrid permanent anchor applied to the present disclosure and a compression type of the related art.

FIG. 9 is a graph showing values obtained by comparing axial forces (fixed lengths) of the hybrid permanent anchor 100 applied to the present disclosure and a compression type of the related art.

It can be seen that the axial force of the permanent anchor 100 of the present disclosure decreased from 84.8 to 37.4 for 100 kN, from 184.0 to 89.4 for 200 kN, from 283.5 to 140.8 for 300 kN, and from 383.3 to 193.3 for 400 kN, as compared with the compression type of the related art.

It can also be seen that the reduction ratio was 55.9% for 100 kN, 51.4% for 200 kN, 50.3% for 300 kN, and 49.6% for 400 kN.

Therefore, the present disclosure has the following effects. It is possible to distribute and reduce a concentrated-load generated in a permanent anchor to ¼ using only the advantages of a tension type and a compression type; it is possible to reduce a divergence angle by dividing a concentrated load in both sides (up and down); it is possible to reduce the divergence angle of force to be advantageous in terms of maintaining the force for a long period; it is possible to prevent creep (deformation) due to long-period tension at the boundary between the free length and the fixed part; it is possible to secure stability by reducing the outer diameter and length of a permanent anchor so that the effect of the permanent anchor is increased; it is possible to prevent damage for a long period of time by distributing load at a lower fixed part when a free anchor length is tensed; it is possible to prevent breakage between concrete and an anchor; and it is possible to prevent breakage of concrete at the boundary between a tension type and a compression type.

It is possible to achieve substantially the same result from the spirit of the hybrid permanent anchor of the present disclosure, and particularly, it is possible to contribute to industrial development by promoting technical development by achieving the present disclosure, so the present disclosure sufficiently deserves to be protected.

What is claimed is:

1. A hybrid permanent anchor for distributing and reducing a concentrated load in the permanent anchor, comprising:

a fixed body disposed between a compression part and a tension part and coupling the compression part and the tension part to each other;

the tension part coupled to a front end of the fixed body and transmitting tension to the permanent anchor when tensile stress is generated;

the compression part coupled to a rear end of the fixed body and transmitting compressive force to the permanent anchor when compressive stress is generated;

a PC (prestressed concrete) steel strand coupled to a rear end of the compression part and having a protective pipe thereon; and an anchor head part fixing the permanent anchor to a structure.

2. The hybrid permanent anchor of claim 1, wherein the fixed body has a bolt for coupling to a fastening hole of the tension part at the front end thereof and has a locking portion for coupling a first set screw to the compression part at the rear end thereof.

3. The hybrid permanent anchor of claim 1, wherein the tension part has a fastening hole for fastening to a bolt of the fixed body and has one or more put-in holes, such that a concrete is put into the one or more put-in holes.

4. The hybrid permanent anchor of claim 1, wherein the compression part and the pipe are coupled to each other by a second set screw and a tube protecting the second set screw is fitted on an outer surface of the second set screw.

5. The hybrid permanent anchor of claim 1, wherein the tension part has:

a first tension body having a fastening hole for fastening a bolt of the fixed body;

one or more tension wedges fastened inside the first tension body and holding wires;

the wires each having one side coupled to the tension wedge and another side coupled to a second tension body; and a coil coupled between the first tension body and the second tension body and increasing attachment resistance to grout.

* * * * *